US005632596A

United States Patent [19]

Ross

[11] Patent Number: 5,632,596

[45] Date of Patent: May 27, 1997

[54] LOW PROFILE ROTORS AND STATORS FOR MIXERS AND EMULSIFIERS

[75] Inventor: James C. Ross, Ridge, N.Y.

[73] Assignee: Charles Ross & Son Co., Hauppauge, N.Y.

[21] Appl. No.: 504,177

[22] Filed: Jul. 19, 1995

[51] Int. Cl.[6] ..... B01F 3/08

[52] U.S. Cl. ..... 415/83; 416/236 R; 366/304; 241/261.3; 241/261

[58] Field of Search ..... 415/76, 83, 90; 416/4, 236 R, 236 A; 366/304; 241/261, 261.3

[56] References Cited

U.S. PATENT DOCUMENTS

| | | | |
|---|---|---|---|
| 2,226,429 | 12/1940 | Hall | 241/261 |
| 2,321,599 | 6/1943 | Hofmann | 366/304 |
| 2,606,502 | 8/1952 | Carlson | 415/83 |
| 2,859,917 | 11/1958 | Reerink et al. | 241/261 |
| 2,969,960 | 1/1961 | Gurley, Jr. | 416/236 R |
| 3,318,580 | 5/1967 | Simonetti | 416/236 R |
| 5,141,328 | 8/1992 | Dilley | 416/236 R |
| 5,427,499 | 6/1995 | Kirby | 415/90 |

FOREIGN PATENT DOCUMENTS

| | | | |
|---|---|---|---|
| 63-297793 | 12/1988 | Japan | 415/90 |

*Primary Examiner*—James Larson
*Attorney, Agent, or Firm*—Galgano & Burke

[57] ABSTRACT

A rotor-stator assembly includes a rotor and a stator, each of which has a plurality of teeth wherein the height of the teeth is less than approximately one twentieth the diameter of the rotor-stator. According to a presently preferred embodiment of the invention, the height of the teeth on the rotor-stator is approximately 1/48th the diameter of the rotor-stator. A twelve inch diameter rotor-stator having teeth 1/4" high can be rotated at 3600 rpm with 40 HP when mixing materials with water-like viscosity. The arrangement of the teeth on the rotor-stator is preferably concentric with radial grooves, but angled grooves may also be used. The teeth my have a triangular or square profile and the dimensions of the teeth, other than their height, may vary considerably.

12 Claims, 8 Drawing Sheets

LOW PROFILE ROTORS AND STATORS FOR MIXERS AND EMULSIFIERS

FIELD OF THE INVENTION

The invention relates to mixers and emulsifiers used in industrial applications. More particularly, the invention relates to rotors and stators which are used in industrial mixers and emulsifiers.

STATE OF THE ART

Industrial mixers and emulsifiers are used to blend various materials such as adhesives, coatings, cosmetics, foods, pharmaceuticals, plastics, etc. Depending on the processing requirements, mixers/emulsifiers may be arranged as a "batch" mixer or an "in-line" mixer. In either case, high speed mechanical and hydraulic shearing forces are created by rotating a rotor relative to a stator such that material is drawn axially into the rotor-stator assembly and dispersed radially outward from the rotor-stator assembly. Prior art FIG. 1 shows a schematic representation of a typical rotor-stator assembly 10. The rotor 12 is a stainless steel disk 14 with a number of teeth or vanes 16 and the stator 18 is a stainless steel cylinder having radial openings 20. The rotor 12 is mounted coaxially within the stator 18 and is rotated at a typical speed of 3600 rpm. A close clearance between the rotor and the stator generates a shearing action. Many different rotor and stator designs are in use today. Prior art FIG. 2 shows another type of rotor-stator assembly 22 shown in schematic form. Here the rotor 24 and the stator 26 are substantially similar stainless steel cylinders each having a plurality of teeth or blades 28, 30 which define a plurality of radial openings 32, 34 in the cylinder. The rotor 24 has a slightly smaller diameter than the stator 26 and generates a shearing action between the openings 32, 34 as it rotates relative to the stator 26. Prior art FIG. 3 shows a "multi-rowed" rotor-stator assembly 36. The multi-rowed rotor 38 and the multi-rowed stator 40 are similar cylindrical members each having arrays of teeth 42, 44 arranged in concentric circles. The rotor 38 and the stator 40 are dimensioned so that the rotor 38 fits inside the stator 40 with the rotor teeth 42 and the stator teeth 44 interleaved. Rotor-stator assemblies are available in a variety of sizes, ranging in diameter from two to thirteen inches. The teeth or vanes on a rotor-stator typically have a height which is approximately one tenth to one fifth the diameter of the rotor-stator.

It has been discovered by the inventors herein that the efficiency of the shearing action of a rotor-stator is mostly influenced by the tangential velocity or "tip speed" of the rotor. As the tip speed is increased, better shearing is achieved. The tip speed may be increased in two ways: either by increasing the rotational speed of the rotor, or by increasing the diameter of the rotor. In either case, more energy is required to rotate the rotor. It has also been discovered that for a constant rotational speed, as the diameter of the rotor is increased, the horse power required to rotate the rotor increases geometrically. Thus, in order to spin a thirteen inch diameter conventionally designed rotor at 3600 rpm, approximately 250 HP is required when mixing materials with water-like viscosity. By comparison, a four inch diameter conventionally designed rotor can be rotated at 3600 rpm with 10 HP when mixing materials with water-like viscosity.

SUMMARY OF THE INVENTION

It is therefore an object of the invention to provide rotor-stator assemblies which have a high shearing action.

It is also an object of the invention to provide rotor-stator assemblies which have large diameters.

It is another object of the invention to provide rotor-stator assemblies which are energy efficient.

It is a further object of the present invention to provide low profile rotor assemblies especially intended for mixers and emulsifiers.

It is still another object of the invention to provide rotor-stator assemblies which are suitable for a variety of applications.

In accord with these objects which will be discussed in detail below, the rotor-stator assemblies of the present invention include a rotor and a stator, each of which has a plurality of teeth wherein the height of the teeth is less than approximately one twentieth the diameter of the rotor-stator. According to a presently preferred embodiment of the invention, the height of the teeth on the rotor and/or stator is approximately 1/48 the diameter of the rotor-stator. A twelve inch diameter rotor and/or stator having teeth ¼" high can be rotated at 3600 rpm with 40 HP when mixing materials with water-like viscosity. The arrangement of the teeth on the rotor-stator is preferably concentric with radial grooves, but angled grooves may also be used. The teeth may have, e.g., a triangular, square, round rectangular or other suitable profile and the dimensions of the teeth, other than their height, may vary considerably.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 4:
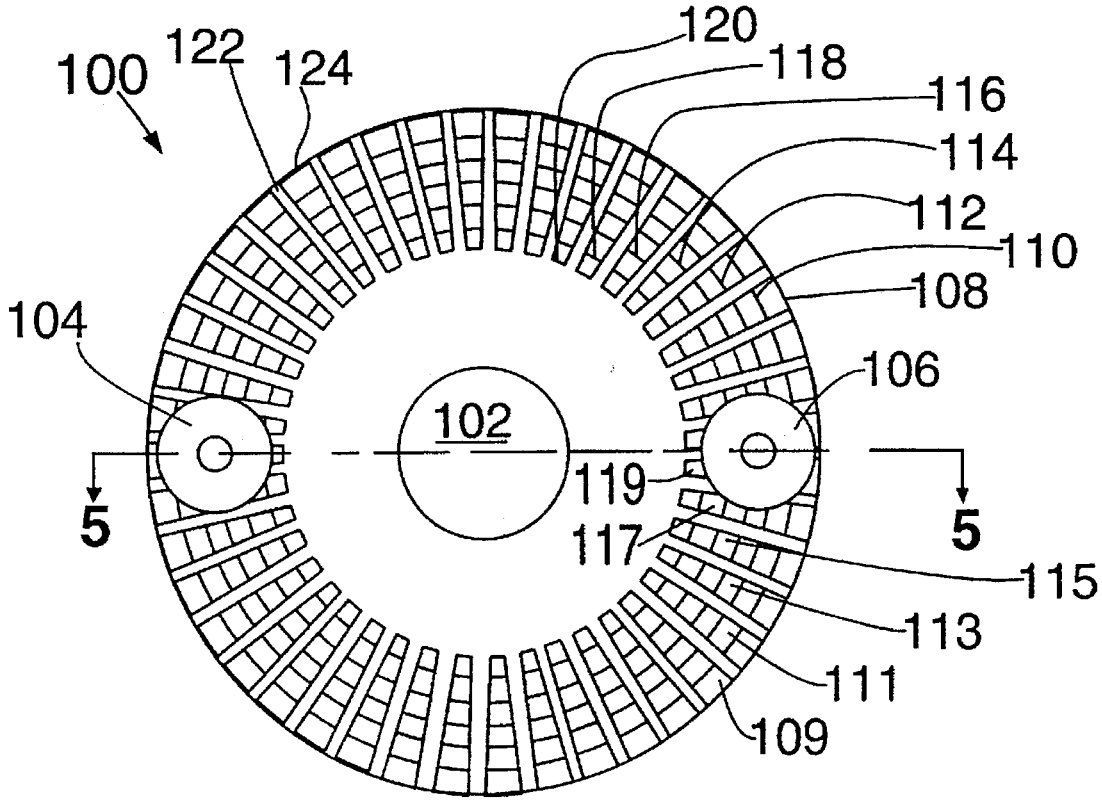
FIG. 4 is a plan view of a first embodiment of a stator according to the invention.
Figure 5:
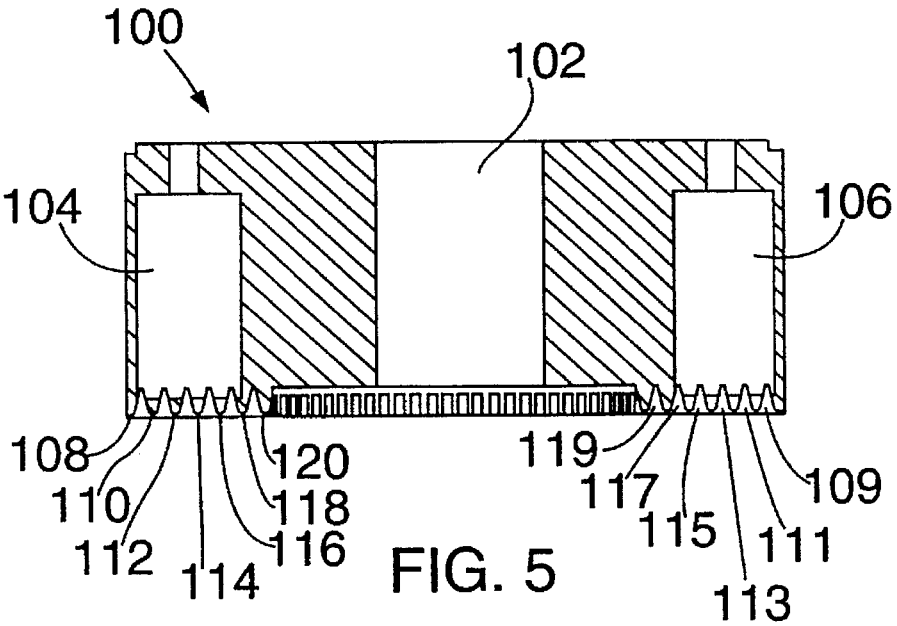
FIG. 5 is a cross sectional view take along line 5—5 in FIG. 4.

Referring now to FIGS. 4 and 5, a first embodiment of a stator 100 according to the invention is a stainless steel disk having a central fluid opening 102 and a pair of diametrically opposed mounting holes 104, 106. One surface of the stator 100 is provided with seven concentric vanes 108, 110, 112, 114, 116, 118, 120 which define six concentric wells 109, 111, 113, 115, 117, 119. Forty-five radial slots, e.g. 122, are arranged at intervals of 8°, thereby defining forty six teeth, e.g. 124, in each vane. According to a first embodiment of the invention, the height of the vanes (and thus the depth of the wells) is approximately one twenty-fourth the diameter of the stator. For example, a six inch diameter stator 100 is provided with vanes which are 0.25 inches high. As seen best in FIG. 5, the vanes have a triangular profile and the angle at the apex of each vane is approximately 30°. In the exemplary six inch diameter stator 100, the vanes are radially spaced apart by approximately 0.4 inches. The central fluid opening 102 is approximately 1.5 inches in diameter and the radial slots, e.g. 122, are each approximately 0.12 inches wide and 0.15 inches deep. The mounting holes 104, 106 are preferably 0.375 inch diameter through bores with 0.75 inch diameter counter sinks approximately 1 inch deep. The overall height of the stator 100 is dimensioned to provide proper clearance with the rotor as described below.

Figure 6:
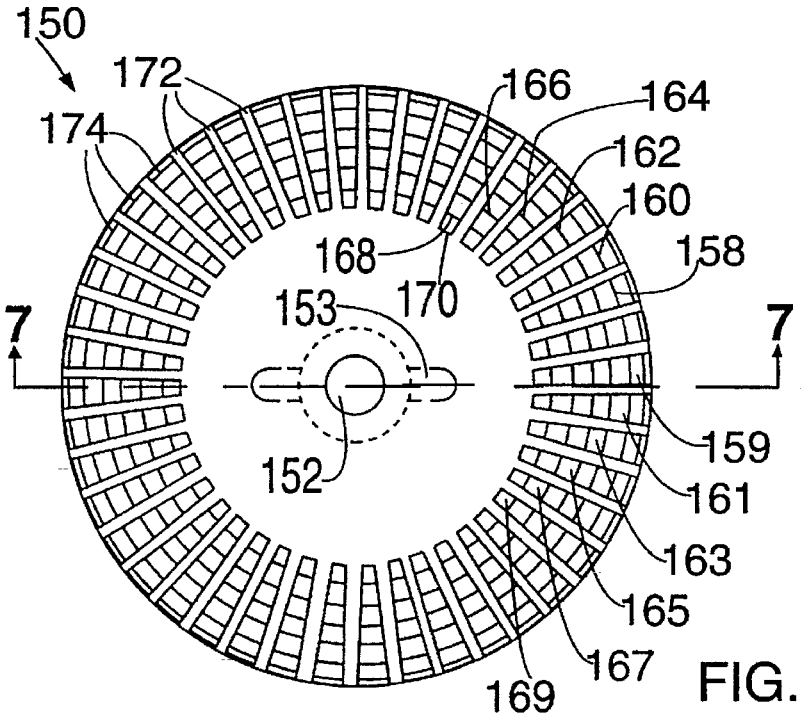
FIG. 6 is a plan view of a first embodiment of a rotor according to the invention.
Figure 7:
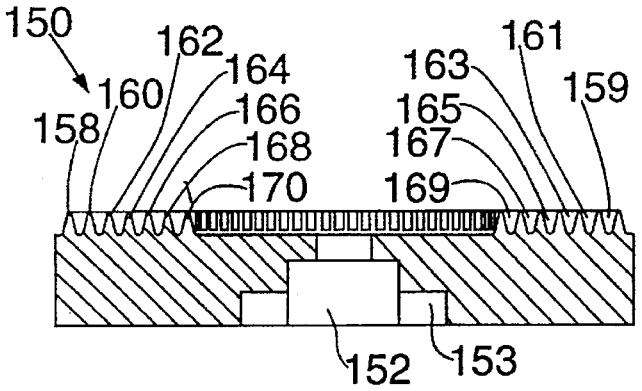
FIG. 7 is a cross sectional view take along line 7—7 in FIG. 6.
Figure 8:
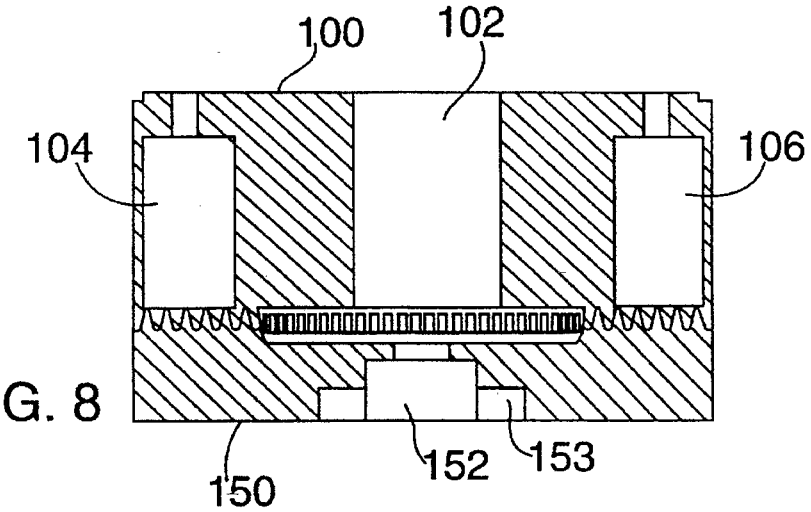
FIG. 8 is a view similar to FIGS. 5 and 7 showing a first embodiment of a rotor-stator assembly according to the invention.

Turning now to FIGS. 6 and 7, a mating rotor 150 is similar to the above described stator 100. The rotor 150 is a stainless steel disk having a central keyed mounting hole 152. One surface of the rotor 150 is provided with seven concentric vanes 158, 160, 162, 164, 166, 168, 170 which define six concentric wells 159, 161, 163, 165, 167, 169. Forty-five radial slots, e.g. 172, are arranged at intervals of 8°, thereby defining forty six teeth, e.g. 174, in each vane. The rotor 150 is dimensioned to match the stator 100. Therefore, the rotor 150 has a diameter of approximately six inches, with vanes which are 0.25 inches high. As seen best in FIG. 7, the vanes have a triangular profile and the angle at the apex of each vane is approximately 30°. The vanes are radially spaced apart by approximately 0.4 inches and the radial slots, e.g. 172, are each approximately 0.12 inches wide and 0.15 inches deep. The mounting hole 152 is preferably 0.563 inch diameter through with a 1.128 inch diameter counter sink approximately 0.562 inches deep. A 2.1 inch wide, 0.312 inch deep key slot 153 is provided for mounting the rotor. Comparing FIGS. 5 and 7, and as illustrated in FIG. 8, it will be vanes in the rotor are placed so that they fit into the wells in the stator. The overall heights of the rotor 150 and the stator 100 are dimensioned to provide proper clearance between the rotor and the stator as shown in FIG. 8. With the exemplary rotor and stator thus described, a clearance of approximately 0.02 inches is provided between the rotor and the stator. Depending on the application of the rotor-stator, the overall heights will be dimensioned to provide that clearance.

The rotor-stator shown in FIGS. 4–8 may be made with a diameter of approximately 11.6 inches with the same vane height of 0.25 inches. In the larger diameter version, however, the number of vanes may be increased to eleven with the same dimensional spacing. The larger diameter rotor-stator may also be provided with seventy-two radial slots, each 0.12 inches wide and 0.15 inches deep. Alternatively the slots may be dimensioned 0.06 inches wide. The central fluid passage in the stator would be approximately twice as large, although the mounting hole in the rotor may be the same size as the smaller diameter rotor. In order to conserve the energy needed to rotate the rotor, the large diameter rotor may be provided with an overall height of approximately one inch. Alternatively, the rear surface of the rotor may taper radially outward. An intermediate diameter rotor-stator assembly may also be provided with an overall diameter of eight inches. The height of the vanes may be increased slightly to 0.281 inches and the vanes may be provided with an apex angle of approximately 20°. With an apex angle of 20°, an eight inch diameter rotor-stator may be provided with fourteen vanes spaced approximately 0.25 inches apart. Moreover, the rotor-stator assembly may be made with an overall diameter of approximately two and one half inches with a vane height of approximately 0.125 inches and a vane apex angle of approximately 20°. In this very small diameter embodiment, up to sixteen vanes may be provided and spaced apart approximately 0.124 inches.

Figure 9:
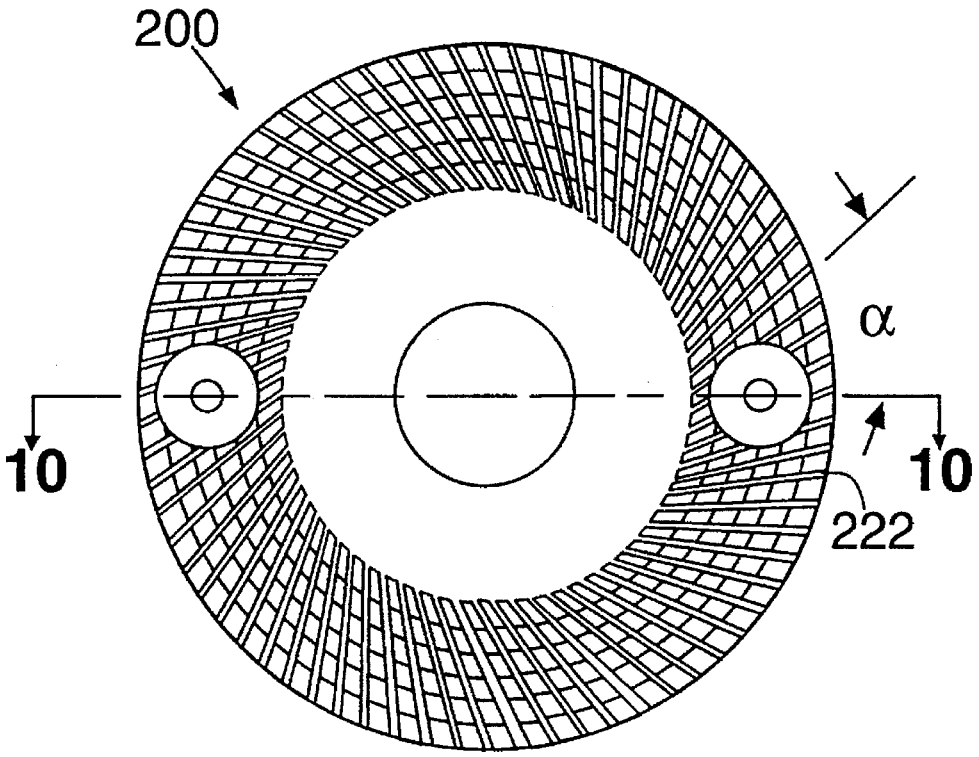
FIG. 9 is a plan view of a second embodiment of a stator according to the invention.
Figure 10:
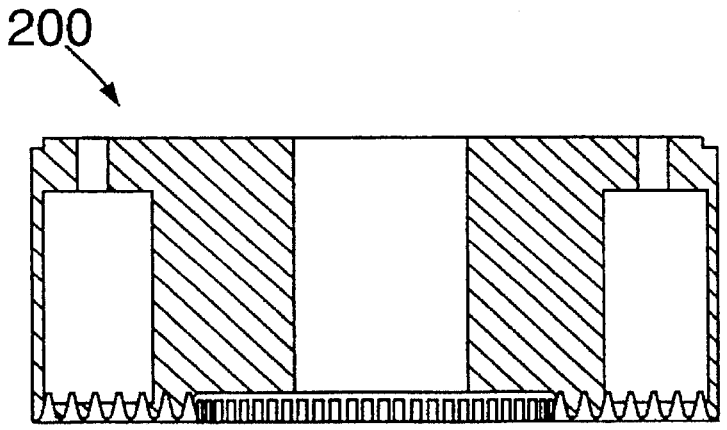
FIG. 10 is a cross sectional view take along line 10—10 in FIG. 9.
Figure 11:
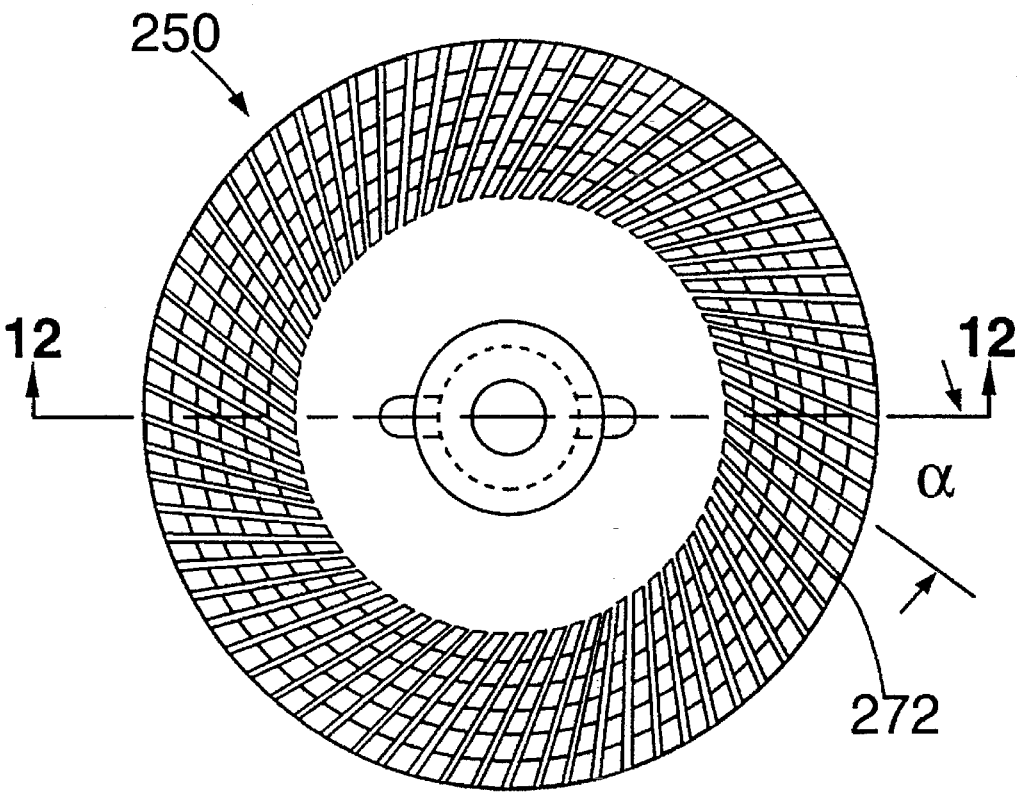
FIG. 11 is a plan view of second embodiment of a rotor according to the invention.
Figure 12:
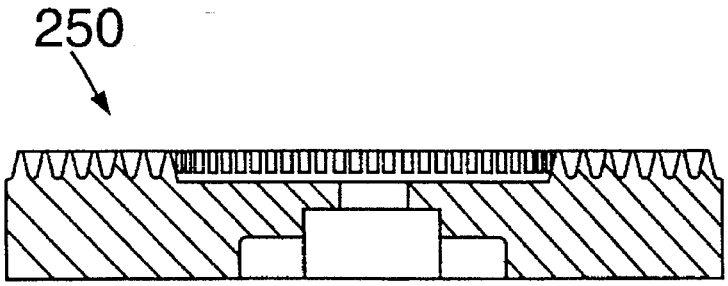
FIG. 12 is a cross sectional view take along line 12—12 in FIG. 6.

FIGS. 9 and 10 show a second embodiment of a stator 200 which is substantially the same as the stator 100 described above. In this embodiment, however, seventy-two slots, e.g. 222, are arranged at an angle $\alpha$ from the radius. The angle is preferably 35° and the slots 0.06 inches wide by 0.15 inches deep. A corresponding rotor 250 is shown in FIGS. 11 and 12. The rotor 250 is substantially the same as the rotor 150 described above. In this embodiment, however, seventy-two slots, e.g. 272, are arranged at an angle $\alpha$ from the radius. The angle is preferably 35° and the slots 0.06 inches wide by 0.15 inches deep. The slots may be angled in either direction, but preferably the slots on the rotor and the stator are angled in the same direction when the rotor and stator are assembled. The slots may be either 0.06 inches wide or 0.12 inches wide.

The rotor-stator shown in FIGS. 9–12 may be made with a diameter of approximately 11.6 inches with the same vane height of 0.25 inches. In the larger diameter version, however, the number of vanes may be increased to eleven with the same dimensional spacing.

Figure 13:
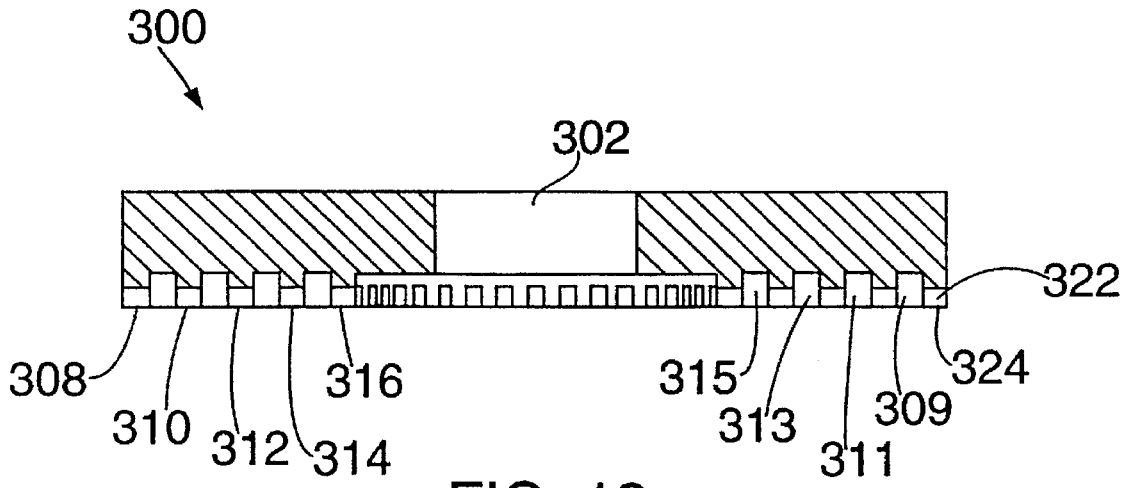
FIG. 13 is a view similar to FIGS. 5 and 10 of a third embodiment of a stator according to the invention.
Figure 14:
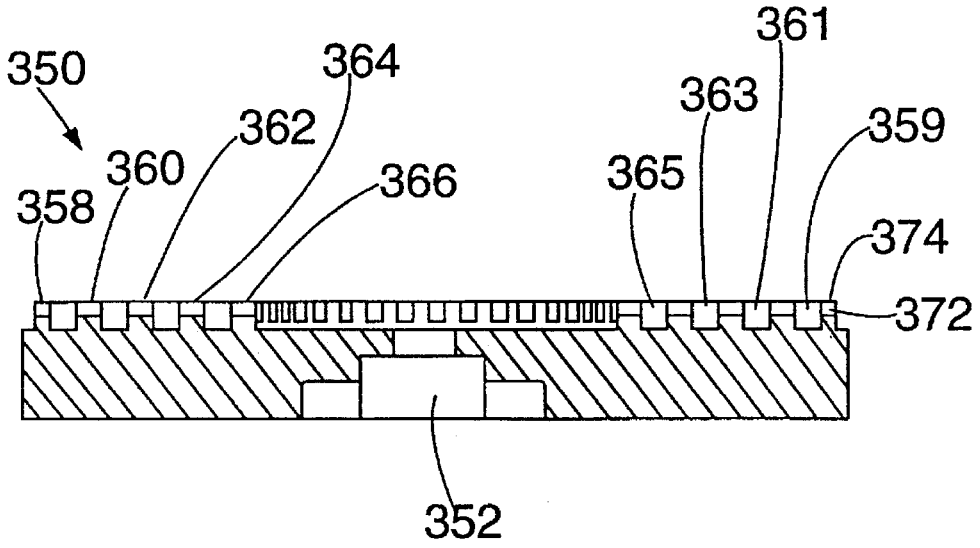
FIG. 14 is a view similar to FIGS. 7 and 12 of a third embodiment of a rotor according to the invention.

The rotors and stators described thus far have been shown with sharp teeth formed by slots in their vanes. The apex angle of the vanes provides each tooth with a sharp edge. Nevertheless, the rotors and stators according to the invention may be provided with rectangular teeth as shown in FIGS. 13 and 14. The stator 300 shown in FIG. 13 is an eight inch diameter stainless steel disk having a central fluid opening 302 and five concentric vanes 308, 310, 312, 314, 316 which define four concentric wells 309, 311, 313, 315. The vanes are approximately 0.281 inches tall and approximately 0.25 inches wide. Thirty-six radial or angled slots, e.g. 322, are arranged at intervals of 10° thereby defining thirty-five teeth, e.g. 324, in each vane. The slots are preferably 0.12 inches wide and 0.15 inches deep. Alternatively, the stator 300 may be provided with eight vanes approximately 0.281 inches tall and approximately 0.125 inches wide.

A mating rotor 350, shown in FIG. 14, is a stainless steel disk having a central keyed mounting hole 352. One surface of the rotor 350 is provided with five concentric vanes 358, 360, 362, 364, 366 which define four concentric wells 359, 361, 363, 365.

The vanes are approximately 0.281 inches tall and approximately 0.25 inches wide. Thirty-six radial or angled slots, e.g. 372, are arranged at intervals of 10° thereby defining thirty-five teeth, e.g. 374, in each vane. The slots are preferably 0.12 inches wide and 0.15 inches deep. Alternatively, the rotor 350 may be provided with eight vanes approximately 0.281 inches tall and approximately 0.125 inches wide, provided that the stator is similarly arranged.

Figure 1:
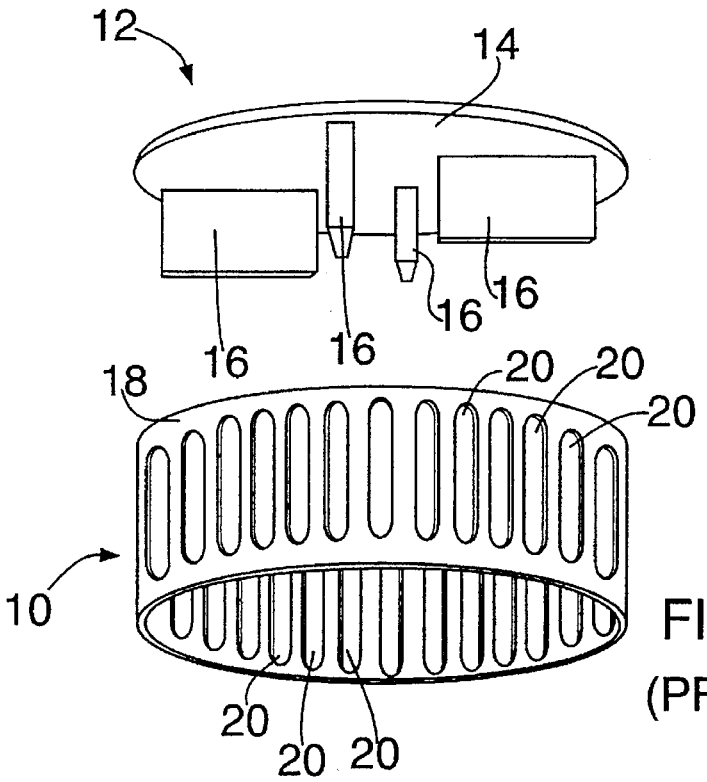
FIG. 1 (PRIOR ART)
FIGS. 1–3 are exploded schematic perspective views of prior art rotor-stator assemblies.
Figure 2:
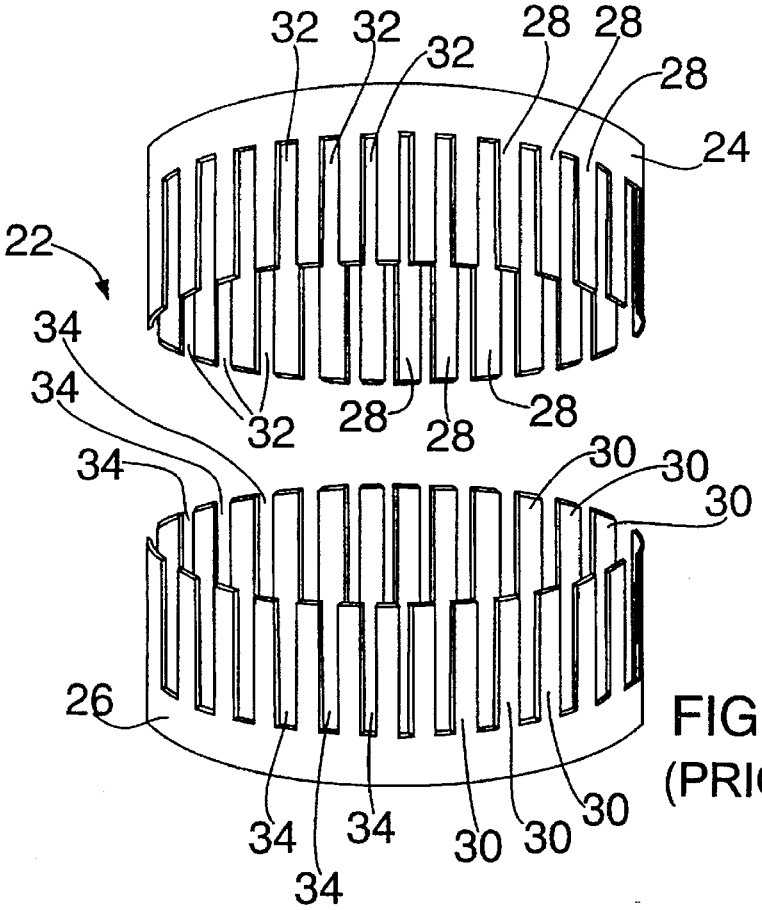
FIG. 2 (PRIOR ART)
Figure 3:
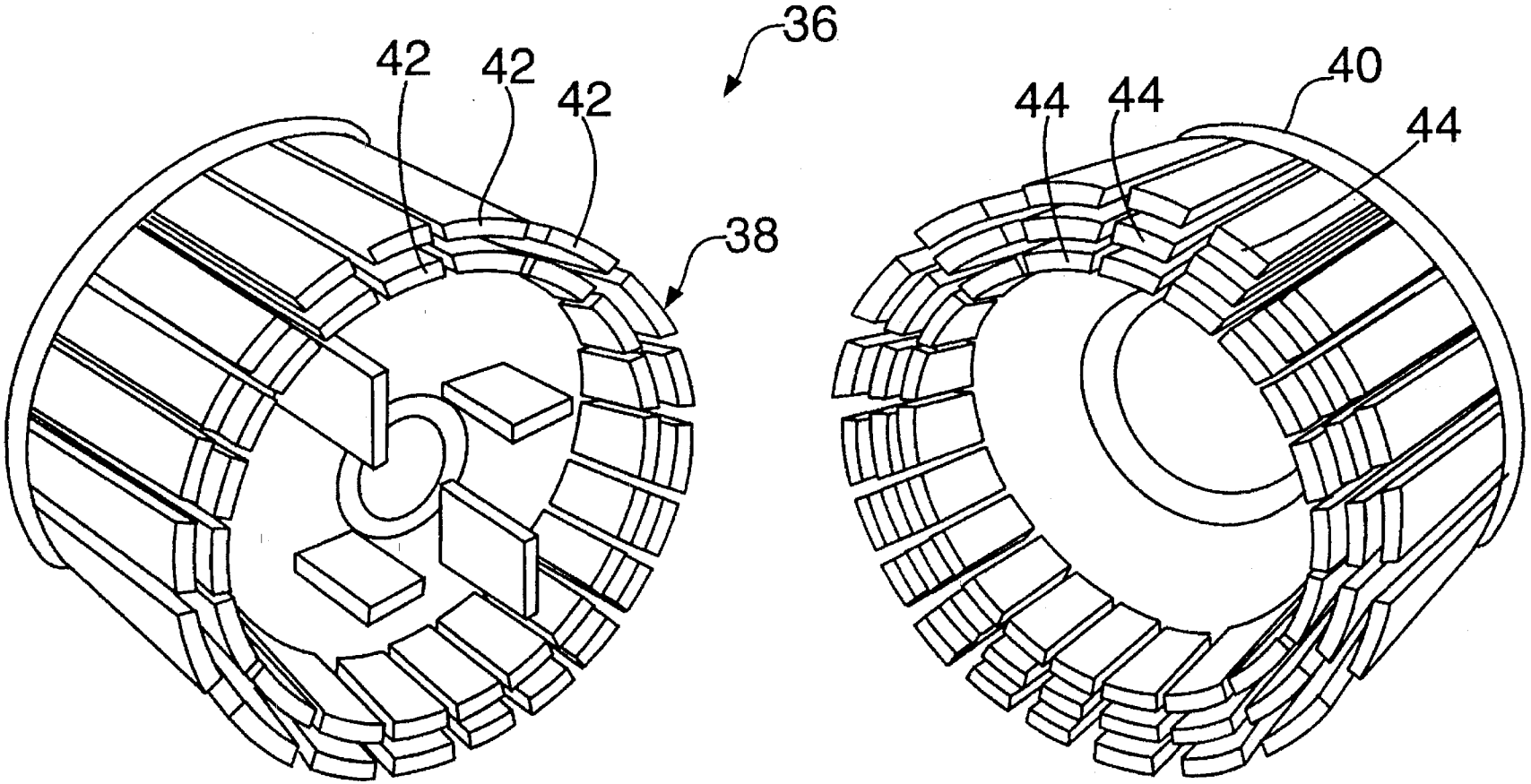
FIG. 3 (PRIOR ART)
Figure 15:
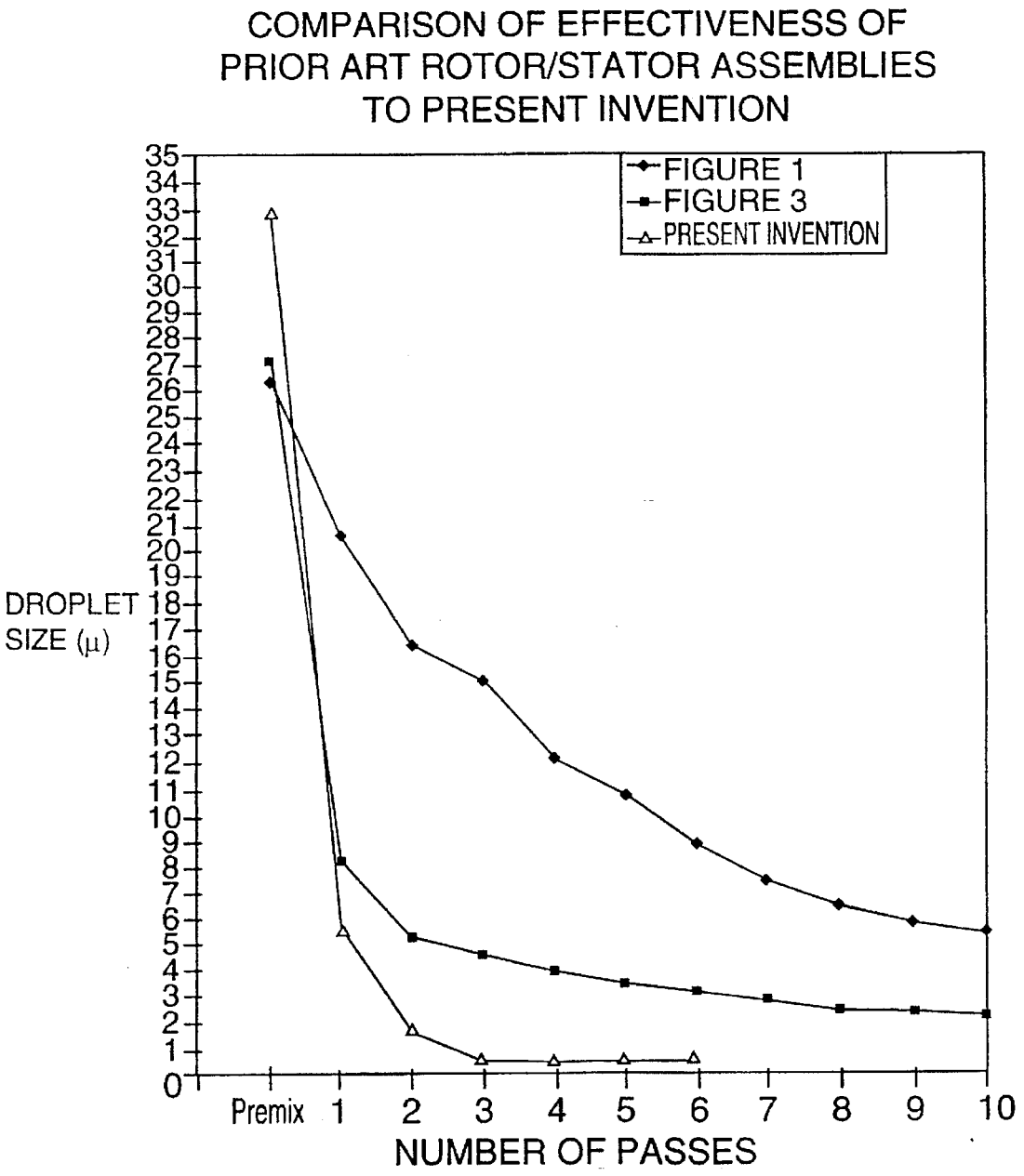
FIG. 15 is a comparative graph illustrating the effectiveness of the present invention to the prior art designs of FIGS. 1 and 3.

For comparative purposes, an illustrative example of the effectiveness of the present invention is provided below in tabular format with the accompanying graph represented in FIG. 15. The test compares the prior art rotor-stator designs illustrated in FIGS. 1 and 3 compared to the rotor-stator design of the present invention. The FIG. 1 prior art design represents a standard slotted rotor-stator having a stator inside diameter and a rotor outside diameter of approximately 3.5". The rotor has a 1" blade height and the stator has a 1" slot height. The FIG. 3 prior art design represents a multi-row design having a three-row with a 3.5" inside diameter, a 5.5" outside diameter and a slot or tooth height of ⅞" for each slot. The four-row rotor has an outside diameter of 6" and an inside diameter of 3" and a slot or tooth height of ⅞". The particular embodiment of the present invention used in the comparison test comprises a novel rotor-stator design having an outside diameter of 11.5" with a tooth height of ¼" or, in other words, a rotor diameter to tooth height ratio of 46:1.

In particular, the table below represents the relative droplet diameter (microns-μ) of a mixture comprising of mineral oil (10%) and water (90%) at room temperature after a series of passes using each of the above-mentioned rotor-stator designs. The results were then plotted in graphical format (See FIG. 15).

| Number of Passes | Droplet Size | | |
|---|---|---|---|
| | FIG. 1 | FIG. 3 | Present Invention |
| Premix | 26.21 | 27.11 | 32.79 |
| 1 | 20.49 | 8.13 | 5.46 |
| 2 | 16.26 | 5.18 | 1.76 |
| 3 | 14.91 | 4.54 | 0.68 |
| 4 | 12.02 | 3.91 | 0.56 |
| 5 | 10.64 | 3.41 | 0.52 |
| 6 | 8.71 | 3.09 | 0.51 |
| 7 | 7.32 | 2.74 | — |
| 8 | 6.31 | 2.46 | — |
| 9 | 5.66 | 2.23 | — |
| 10 | 5.24 | 2.12 | — |

It can easily be seen from the above comparative results that the new design of the present invention decreases the droplet diameter of the mixture to a submicron level after the third pass representing a dramatic improvement in rotor-stator efficiency over the prior art designs.

There have been described and illustrated herein several embodiments of a rotor-stator assembly. While particular embodiments of the invention have been described, it is not intended that the invention be limited thereto, as it is intended that the invention be as broad in scope as the art will allow and that the specification be read likewise. Thus, while particular dimensions have been disclosed with regard to diameters of the rotors and stators, it will be appreciated that other diameters could be utilized. Also, while radial and angled slots have been shown, it will be recognized that other types of slots and slots with other dimensions could be used with similar results obtained. Moreover, while particular configurations have been disclosed in reference to mounting holes and fluid passage holes, it will be appreciated that other configurations could be used as well. Furthermore, while the vanes defining the teeth in the rotors and stators have been disclosed as having a height of between 0.125 and 0.281 inches, it will be understood that the height of the vanes and thus the teeth should be no greater than 1/20th and preferably between 1/60th and 1/20th the diameter of the rotor-stator according to the invention.

It will therefore be appreciated by those skilled in the art that yet other modifications could be made to the provided invention without deviating from its spirit and scope as so claimed.

I claim:

1. A rotor-stator assembly for producing sub-micron droplet size liquid—liquid emulsions, said assembly comprising:

a) a substantially cylindrical stator having a plurality of substantially circular rows of teeth arranged concentrically on a first surface thereof, said teeth having a height which is approximately between one twentieth and one forty-sixth of the diameter of said substantially cylindrical stator, wherein said plurality of rows of teeth are formed by a plurality of concentric vanes and a plurality of grooves which cross said vanes, and wherein said grooves are arranged at an angle from radius lines of said cylindrical rotor; and b) a substantially cylindrical rotor having a plurality of substantially circular rows of teeth arranged concentrically on a first surface thereof, said teeth having a height which is approximately between one twentieth and one forty-sixth of the diameter of said substantially cylindrical rotor, wherein said plurality of rows of teeth are formed by a plurality of concentric vanes and a plurality of grooves which cross said vanes, and wherein said grooves are arranged at an angle from radius lines of said cylindrical rotor.

2. A rotor-stator assembly according to claim 1, wherein: said vanes have a triangular profile.

3. A rotor-stator assembly according to claim 1, wherein: said vanes have a rectangular profile.

4. A rotor-stator assembly according to claim 2, wherein: said vanes have an apex angle of twenty to thirty degrees.

5. A rotor for use with a substantially cylindrical stator having a plurality of substantially circular rows of teeth and for producing sub-micron droplet size liquid—liquid emulsions, said rotor comprising:

a substantially cylindrical member having a plurality of substantially circular rows of teeth arranged concentrically on a first surface thereof, wherein said teeth have a height which is approximately between one twentieth and one forty-sixth of the diameter of said substantially cylindrical member, wherein said plurality of rows of teeth are formed by a plurality of concentric vanes and a plurality of grooves which cross said vanes, and wherein said grooves are arranged at an angle from radius lines of said cylindrical stator.

6. A rotor according to claim 5, wherein: said vanes have a triangular profile.

7. A rotor according to claim 5, wherein: said vanes have a rectangular profile.

8. A rotor according to claim 6, wherein: said vanes have an apex angle of twenty to thirty degrees.

9. A stator for use with a substantially cylindrical rotor having a plurality of substantially circular rows of teeth and for producing sub-micron droplet size liquid—liquid emulsions, said stator comprising:

a substantially cylindrical member having a plurality of substantially circular rows of teeth arranged concentrically on a first surface thereof, wherein said teeth have a height which is approximately between one twentieth and one forty-sixth of the diameter of said substantially cylindrical member, wherein said plurality of rows of teeth are formed by a plurality of concentric vanes and a plurality of grooves which cross said vanes, and wherein said grooves are arranged at an angle from radius lines of said cylindrical stator.

10. A stator according to claim 9, wherein: said vanes have a triangular profile.

11. A stator according to claim 9, wherein: said vanes have a rectangular profile.

12. A stator according to claim 10, wherein: said vanes have an apex angle of twenty to thirty degrees.

* * * * *